US006794643B2

(12) United States Patent
Russ, IV et al.

(10) Patent No.: US 6,794,643 B2
(45) Date of Patent: Sep. 21, 2004

(54) MULTI-MODE SIGNAL OFFSET IN TIME-OF-FLIGHT MASS SPECTROMETRY

(75) Inventors: Charles William Russ, IV, Sunnyvale, CA (US); William D. Frazer, Mountain View, CA (US)

(73) Assignee: Agilent Technologies, Inc., Palo Alto, CA (US)

( * ) Notice: Subject to any disclaimer, the term of this patent is extended or adjusted under 35 U.S.C. 154(b) by 54 days.

(21) Appl. No.: 10/349,777

(22) Filed: Jan. 23, 2003

(65) Prior Publication Data

US 2004/0144917 A1 Jul. 29, 2004

(51) Int. Cl.[7] ..... H01J 49/40

(52) U.S. Cl. ..... 250/287; 250/397

(58) Field of Search ..... 250/287, 310, 250/307, 214, 339.07; 341/118, 131, 132

(56) References Cited

U.S. PATENT DOCUMENTS

| | | | | |
|---|---|---|---|---|
| 5,367,162 | A | 11/1994 | Holland et al. | |
| 5,463,219 | A | 10/1995 | Buckley et al. | |
| 5,712,480 | A | 1/1998 | Mason | |
| 5,903,523 | A | 5/1999 | Peck | |
| 5,981,946 | A | 11/1999 | Mason | |
| 6,094,627 | A | 7/2000 | Peck et al. | |
| 6,617,567 | B2 * | 9/2003 | Mukherjee et al. | 250/214 A |
| 6,636,319 | B1 * | 10/2003 | Auth et al. | 356/451 |

* cited by examiner

*Primary Examiner*—John R. Lee
*Assistant Examiner*—James J. Leybourne

(57) ABSTRACT

A system and method of processing signals generated at a detector of a mass spectrometer prior to signal conversion in which a pre-ADC offset is applied to the signals that is adjustable in polarity and magnitude in accordance with a user-selected mode. According to a first mode, a positive offset is applied to the signals to improve quantitation accuracy and in a second mode, a negative offset is applied to the signals to improve resolution and mass assignment.

21 Claims, 4 Drawing Sheets

MULTI-MODE SIGNAL OFFSET IN TIME-OF-FLIGHT MASS SPECTROMETRY

FIELD OF THE INVENTION

The present invention relates to mass spectrometry, and more particularly relates to a system and method for improving quantitation accuracy and mass assignment accuracy for time-of-flight mass spectrometers using a signal offset.

BACKGROUND INFORMATION

In the field of mass spectrometry, and particularly with regard to atmospheric pressure ion sources (such as Electrospray, Atmospheric Pressure Chemical Ionization (APCI), and Atmospheric Pressure Matrix-Assisted Laser Desorption Ionization (AP MALDI)), there is an increasing demand for more accurate determination of the empirical formulas of compounds that are introduced and ionized using such systems. For example, in Proteomics research, in which the structure and composition of large and complex protein molecules are studied, mass assignment accuracies on the order of 1 to 2 parts per million (ppm) may be required for correct identification. This high level of mass assignment accuracy can be currently achieved using Time-Of-Flight mass spectrometers (TOF MS) that can attain mass resolution levels of greater than ten thousand.

In addition to the demand for high mass assignment accuracy, in a given analysis there may be a need to accurately measure the heights of individual mass peaks in order to assess the relative abundance of different analytes or to precisely determine ratios of different isotopes within a sample.

In TOF MS systems, ions having different mass-to-charge ratios travel through a drift tube at different speeds and reach a detector at the end of the drift tube in a series of narrow "packets", each packet containing ions of a specific mass-to-charge ratio (hereinafter simply called "mass"). The distribution of ions in time within the packet is translated by the detector and its associated electronics into a mass peak, i.e., data that represent ion number or intensity vs. time or, equivalently, mass. The time (mass) distribution may be approximately Gaussian. Individual packets of ions may be received extremely close together in time, necessitating fast detector systems for detecting and measuring the packets rapidly in order to generate clearly defined peaks centered at specific masses. The resolution of a measurement may be defined as the mass value at peak center divided by the width of the peak at half maximum, for example. The mass accuracy of a measurement is inversely related to the peak width; any widening of the peaks usually will adversely affect the accuracy of determination of the mass corresponding to the peak. In particular, the peaks may widen to the point that neighboring mass peaks partially or completely overlap, making accurate mass assignment extremely difficult.

SUMMARY OF THE INVENTION

The present invention provides a method of processing signals generated at a detector of a mass spectrometer in which an offset is applied to the signals prior to signal conversion. In a first processing mode, an offset is applied to the signals to improve quantitation accuracy, and in a second mode an offset of opposite polarity is applied to the signals to improve resolution and mass assignment.

Additionally, in one embodiment, the present invention provides an apparatus for processing signals generated at the detector of a mass spectrometer that comprises an offset generator for generating a signal offset voltage, a summing amplifier having a first input coupled to the detector for receiving signals generated at the detector, a second input coupled to the offset generator for receiving the signal offset voltage, and an output. The summing amplifier adds the signal offset voltage to detector signals and produces an output that represents a sum voltage thereof.

DETAILED DESCRIPTION

Figure 1:
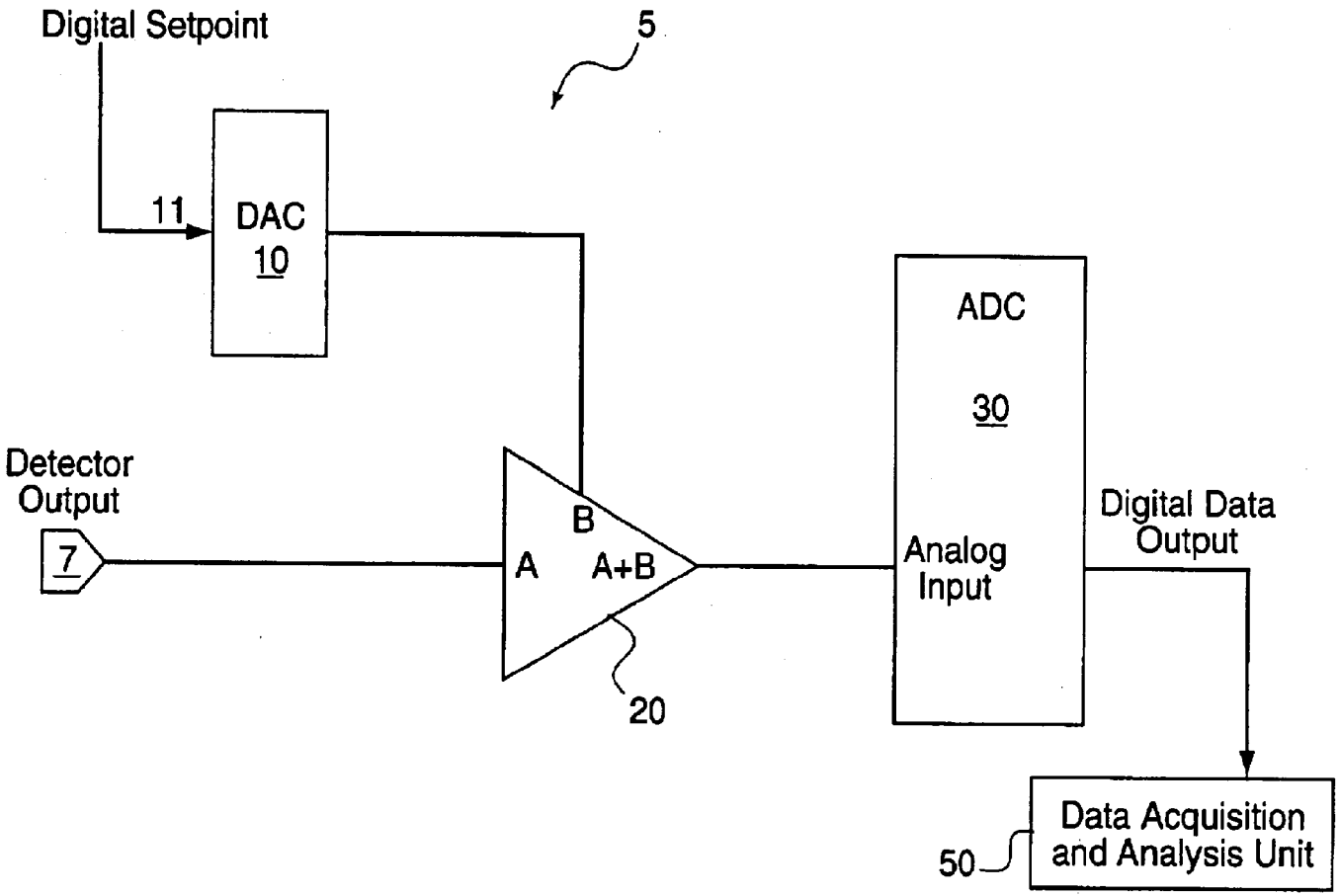
FIG. 1 is a schematic block diagram of a detection system according to an embodiment of the present invention.

The detector system of a mass spectrometer, e.g., a TOF MS, may include a fast detector that generates signal voltage pulses derived from amplified individual ion events at the input to the detector. The signal from the detector is composed of the responses of the detector to the individual events of the ions striking it. For the case of a particle multiplier type of detector, the detector response to the individual events to the ions is a stream of voltage pulses, each pulse having different amplitude within a limited voltage range.

In the context of the present invention, the "signal strength" of the resulting stream of voltage pulses output from the detector is defined as the numerical voltage level, having contributions from both the pulse rate, and the voltage amplitudes of each of the pulses, that is converted to a digital number at a signal converter.

When the numerical values of signal strength output from the signal converter are plotted as a function of time (and therefore, mass), a series of peaks is generated, each peak representing the signal strength output by the signal converter when an ion packet is received. The "peak height" of each peak is defined herein as the maximum value of the signal strength usually located near to the center of each respective peak or the maximal height of a curve that is a computed best fit to the actual signal data. This represents the signal strength at approximately the center of the ion packet.

The signal converter may be, for example, an analog-to-digital converter (ADC), or a time-to-digital converter (TDC). In the case of an ADC, the signal converter converts the received signal voltage pulses (possibly amplified) to a digital signal representative of the magnitude of the signal strength at a given time step, and in particular assigns an integer value to the received signal strength.

ADC's and TDC's are digital devices that have an effective threshold below which they do not respond, i.e., the signal voltage at the input must exceed a minimum threshold value to trigger the first digital bit. For high signal pulse arrival rates, signal pulses may tend to overlap (more than one pulse occurring during the converter sample time) and thereby produce a higher amplitude than a single pulse at the signal converter input, increasing the probability that the signal will exceed the threshold. At lower signal rates, there are less "additions" of signals and thus a higher likelihood that some signals will not be large enough to trigger the first bit. Signals thus tend to be preferentially measured by the converter when the pulse rate is high enough for overlap compared with times when there is little or no overlap. At times near the center of the ion packet, corresponding roughly to the center of the mass peak, the signal will nearly always be strong enough to trigger the converter and be measured. Near the edges of the packet, however, where the pulse rate is lower and overlap unlikely, a higher percentage of the events may not trigger the converter. As a result, the mass peak will appear to be narrowed after the converter and subsequent processing, and resolution will be effectively increased. Similarly, noise effects caused by high sampling rates such as tailing and ringing, which affect the edges of peaks where signal strengths are low, can be removed if the converter threshold is appropriate. The edges of the peaks are trimmed, the peak widths may decrease and resolution and mass accuracy may increase.

The resolution improvement by threshold effects has a consequence however that may be undesirable: impaired magnitude measurement accuracy, which is related to quantitation accuracy. The relation-of processed peak height to input signal strength may be nonlinear. The smaller the signal is, the more it is affected by the threshold effect, and the smaller the measured peak height becomes. For example, isotope ratios of multiple-isotope samples will likely be incorrect, with each separate, measured isotopic peak height becoming progressively smaller than it should be. The present invention provides a means for controlling the resulting trade-off between resolution (mass accuracy) and quantitation accuracy.

In accordance with the present invention, an offset voltage can be added to or subtracted from the amplified detector output signal at the amplifier stage prior to its being counted or measured at the signal converter (hereinafter the signal converter will be referred to as an ADC, although use of a TDC is also contemplated). It is noted that while detector output signals are typically measured in negative volts, for explanatory purposes, such signals are referred to herein as being positive. In the same vein, herein, a "positive offset" means an offset that increases signal strength, while a "negative offset" is an offset that decreases signal strength.

FIG. 1 is a schematic block diagram of a detection system according to an example embodiment of the present invention. Signal pulses from the output of the detector 7 are received at a first terminal (A) of a summing amplifier 15. Simultaneously, an offset generator 40, implemented in this case as a DAC converter, generates a digital setpoint offset voltage that is input to a second terminal (B) of the summing amplifier 15. The offset voltage of the offset generator 40 may be adjusted automatically (and at a high rate) according to a program executed in an electronic processor, or, alternatively, it may be adjusted manually via a control dial. In addition, the offset voltage may be preset and non-adjustable for a given application.

At the summing amplifier 15 the offset input to terminal (B) is added to the detector output received at terminal (A), thus the output of the summing amplifier is the signal plus the offset, and this sum (A+B) may be then multiplied by a further amplification factor. Other means for applying an offset to the signal may include coupling pulses synchronous with the sampling window into the signal channel. This may be accomplished using a directional coupler, for example. The output from the summing amplifier 15 is supplied to the ADC 20, where it is converted to a digital signal and counted according to a signal strength level. In other embodiments, the summing amplifier 15 and the ADC 20 can be combined or the ADC can otherwise include additional functionality to incorporate the offset function of the offset generator. The ADC 20 in turn supplies the converted digital signals to a data acquisition and analysis unit 50 , which builds a spectrum of peaks from the sums representing abundance as a function of mass.

The offset can be used to effect the trade-off between quantitation accuracy and mass assignment accuracy in a given analysis. By setting the offset to a positive value, the detected data values are boosted, i.e., a greater portion of the detected pulse signals surpasses the threshold and is counted by the ADC. In this case the peak height measurement will be more accurate, but the peaks may widen and pick up shape artifacts from noise, reducing mass resolution. If the offset is set to a negative polarity, a greater portion of the detected pulse signals will fall beneath the threshold, leading to narrower and cleaner peaks having inaccurate (reduced) peak heights. It is noted that in a given analysis the offset can be also set to zero, for calibration purposes or otherwise.

The following table demonstrates the effect of both positive and negative offsets with respect to several input signal strength values on resulting data peak heights.

TABLE 1

| | PEAK HEIGHTS (arbitrary units) | | |
|---|---|---|---|
| INPUT SIGNAL STRENGTH | NEGATIVE OFFSET | NO OFFSET | POSITIVE OFFSET |
| 1000 | 219 | 948 | 1191 |
| 10,000 | 3776 | 10062 | 11885 |
| 100,000 | 102873 | 121487 | 125527 |

As the data shown in Table 1 indicates, the lower the input signal strength, the more pronounced the effects of the positive and negative offsets are relative to a non-offset signal. At an input strength of 998, a negative offset produces a peak height less than one quarter of the peak height for a non-offset signal, indicating that the negative offset brings most of the signal below the threshold for detection. At the same input signal strength, a positive offset (of an equal magnitude) increases the resulting peak height by 25%. At higher input signal strength, the effects of the offsets are reduced.

Figure 2:
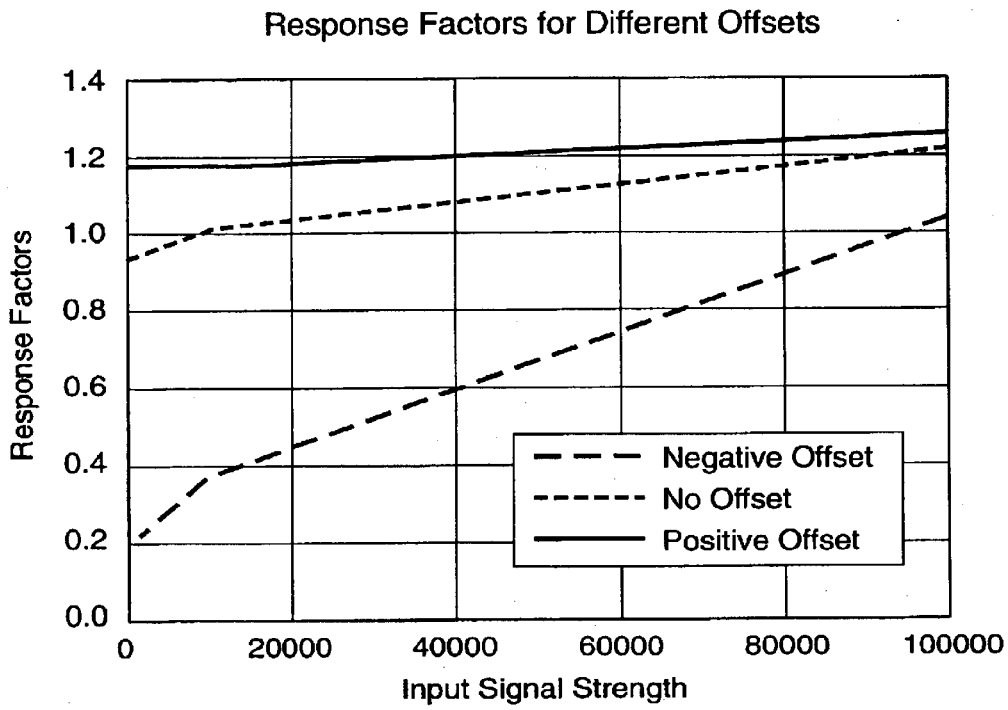
FIG. 2 is a graph of response factor versus input signal strength for the data shown in Table 2.

Table 2 shows response factors (signal output strength divided by signal input strength) for the values shown in Table 1. The response factors should ideally be approximately constant for all intensities. As can be discerned, the negative offset is highly non-linear (the ratio of the maximum to the minimum response factor being almost 5), while the positive offset data shows only a 6% non-linearity (max/min of 1.06). FIG. 2 shows a plot of response factor versus input signal strength graphically illustrating the relative non-linearity of the negative offset data and the relative high linearity of the positive offset data.

TABLE 2

| | Response factors (arbitrary units) | | |
|---|---|---|---|
| INPUT SIGNAL STRENGTH | NEGATIVE OFFSET | NO OFFSET | POSITIVE OFFSET |
| 1000 | 1.97 | 2.45 | 2.64 |
| 10,000 | 1.99 | 2.51 | 2.70 |

TABLE 2-continued

| INPUT SIGNAL STRENGTH | Response factors (arbitrary units) NEGATIVE OFFSET | NO OFFSET | POSITIVE OFFSET |
|---|---|---|---|
| 100,000 | 2.47 | 2.75 | 2.81 |
| Max/Min | 4.68:1 | 1.28:1 | 1.06:1 |

Table 3 shows the effects on peak widths of the relative offsets, with negative offset data having 25% narrower peaks than data without an offset at low input signal strengths.

TABLE 3

| INPUT SIGNAL STRENGTH | PEAK WIDTHS FWHM (ns) NEGATIVE OFFSET | NO OFFSET | POSITIVE OFFSET |
|---|---|---|---|
| 1000 | 1.97 | 2.45 | 2.64 |
| 10,000 | 1.99 | 2.51 | 2.70 |
| 100,000 | 2.47 | 2.75 | 2.81 |

Even at higher input signal strengths, peak widths are considerably smaller when a negative offset is applied to the input signal.

Figure 3:
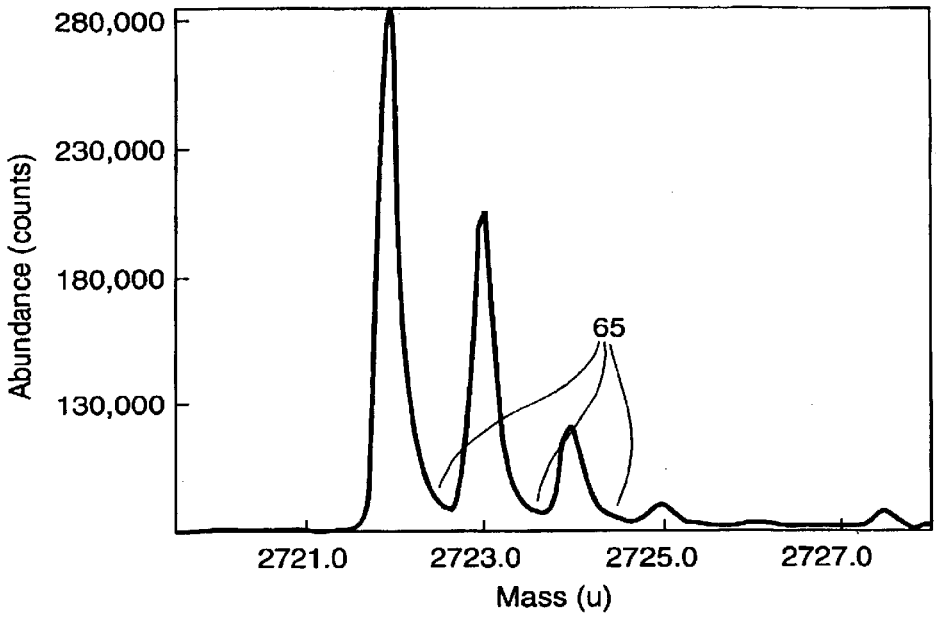
FIG. 3 is a spectrogram of data taken from a TOF mass spectrometer using a positive ADC offset.

FIG. 3 illustrates a spectrogram of data taken from a TOF using a standard tune mix with a positive ADC offset. The analyte sample used to generate the spectrogram of FIG. 3 included molecular isotopes, i.e., molecular compounds of the same molecular formula but having different isotopes of a particular atomic species, and therefore slightly different atomic masses. As can be discerned, the peaks illustrated in FIG. 3 display tailing such as in marked sections 65 and overlapping of isotopes. In contrast, the spectrogram shown in FIG. 4, in which a negative offset was used, shows little tailing and high resolution. For example, the largest peak shown in FIG. 3, with positive offset, has a resolution of approximately 9400, while the largest peak in FIG. 4, with negative offset, has a resolution of approximately 11500. Thus, the negative offset data is cleaner and provides greater mass assignment accuracy.

Figure 4:
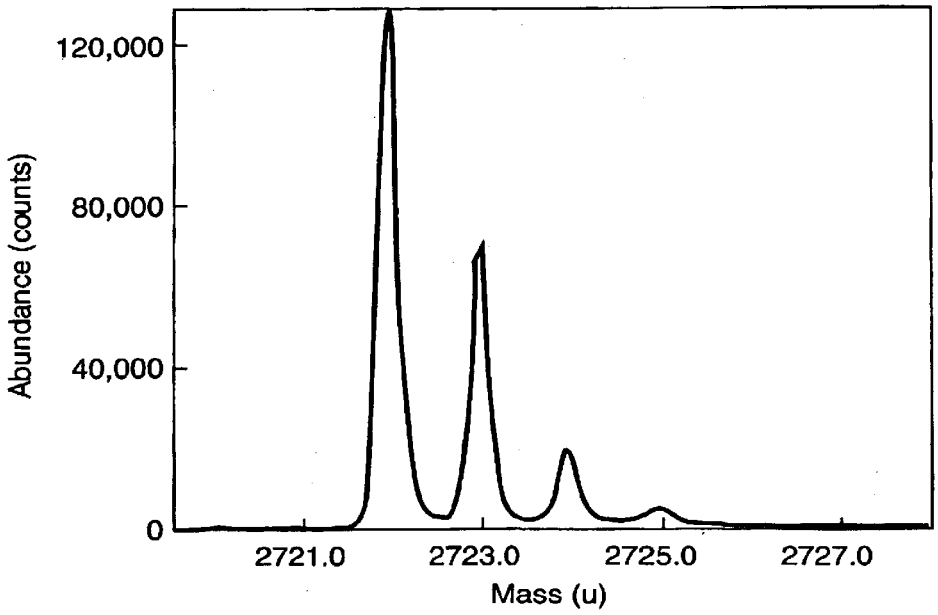
FIG. 4 is a spectrogram of data taken from a TOF mass spectrometer using a negative ADC offset.

However, there is a difficulty associated with data shown in FIG. 4, in that the height of the peaks is incorrect, i.e., the data shows an incorrect ratio between the relative abundance of the isotopes in the sample. Hence, the negatively offset data results in incorrect quantitation accuracy, as expected. Table 4 indicates the peak heights and isotope ratios derived from the peak data illustrated in FIG. 3 and FIG. 4.

TABLE 4

| m/z (amu) | Signal Heights Negative Offset | Positive Offset | Isotope Ratios (%) Negative Offset | Positive Offset | Theoretical |
|---|---|---|---|---|---|
| 2722 | 132.0 | 205.0 | 100.0 | 100.0 | 100.0 |
| 2723 | 69.0 | 126.0 | 52.3 | 61.5 | 61.7 |
| 2724 | 18 | 40.0 | 13.6 | 19.5 | 19.9 |
| 2725 | 3.5 | 10.5 | 2.7 | 5.1 | 4.4 |
| 2726 | 0.6 | 2.0 | 0.5 | 1.0 | 0.8 |

The theoretical percentage shown in Table 4 indicates expected relative abundance of the isotopes in the sample. As can be seen, the isotope ratios derived from the positively offset data are within normal margins of error while the negatively offset data is off by as much as 10% with respect to the abundance of the m/z (mass to charge ratio) of 2723, where the negatively offset data shows 52.3% and the positively offset data shows 61.5%. Thus, in this case increased resolution and clarity comes at the expense of incorrect abundance information.

Given the fact that applying a positive offset (a first mode) provides benefits in one aspect of data analysis, namely quantitation accuracy, and applying a negative offset (a second mode) provides benefits in another aspect of data analysis, namely mass assignment accuracy, it would be advantageous to gain the benefits provided by each of these modes by gathering data according to each by dynamically alternating between the two modes. This may be implemented, for example, by having a programmable electronic processor feed input to the adjustable offset generator. By alternating between the first and second modes, two different data sets can be obtained, and a data processor can combine the sets in a spectrogram having peak shapes obtained via the data set obtained in the second mode and having peak heights (quantitation) obtained via the data set in the first mode. In a particular, when it is determined that the quantitation accuracy of a given apparatus is acceptable when a zero or slightly positive offset is applied, it may be particularly advantageous to alternate between a negative offset and a zero or a slight positive offset during data collection.

Figure 5:
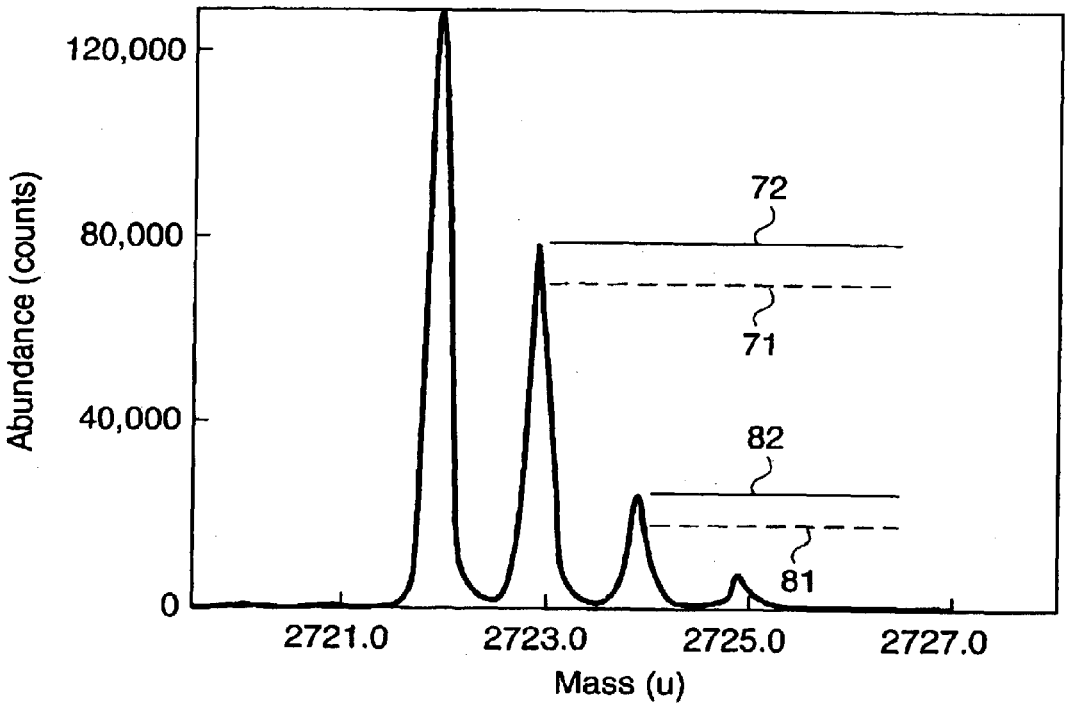
FIG. 5 is a spectrogram of data taken from a TOF by alternating between positive and negative ADC offsets.

FIG. 5 shows an example spectrogram of data obtained while alternating between the first and second modes. As shown, the peak height of the second peak 72 reflects the level shown in FIG. 3 obtained using the first mode, in comparison with the lower peak height level 71 obtained using the second mode (and shown in FIG. 4). Likewise the peak height of the third peak 82 reflects the level shown in FIG. 3 obtained using the first mode, in comparison with the lower peak height 81 obtained using the second mode. However, the resolution of each of the peaks in FIG. 5 reflects the resolution of the peaks shown in FIG. 4, obtained using the second mode. Accordingly, by obtaining data while alternating between the first and second modes, the benefits of each mode can be obtained simultaneously to improve both mass assignment accuracy and quantitation accuracy in a single sample run through a TOF mass spectrometer.

In the foregoing description, the invention has been described with reference to a number of examples that are not to be considered limiting. Rather, it is to be understood and expected that variations in the principles of the systems and methods herein disclosed may be made by one skilled in the art and it is intended that such modifications, changes, and/or substitutions are to be included within the scope of the present invention as set forth in the appended claims.

What is claimed is:

1. A method of processing signals generated at a detector of a mass spectrometer prior to signal conversion comprising:

applying an offset to the signals that is adjustable in polarity and magnitude in accordance with a user-selected mode, the applying of an offset including:

selecting one of a first mode and a second mode;

in the first mode, applying a positive offset to the signals to improve quantitation accuracy; and in the second mode, applying a negative offset to the signals to improve resolution and mass assignment.

2. A method for simultaneously improving quantitation accuracy and, resolution of analyte data derived from signals generated at a detector of a mass spectrometer, comprising:

in a first mode, providing a positive offset to the signals to improve quantitation accuracy;

in a second mode, providing a negative offset to the signals to improve resolution, peak symmetry and mass assignment; and alternating between the first mode and the second mode during detection.

3. The method of claim 2, further comprising:

converting the signals offset in the first mode and the second mode to digital signals; and constructing the analyte data using the digital signals.

4. The method of claim 3, further comprising:

deriving peak heights of the analyte data from the digital signals in the first mode; and deriving peak locations of the analyte data from the digital signals in the second mode.

5. The method of claim 4, wherein the analyte data includes data from compounds that contain more than one isotope of a particular atom.

6. The method of claim 2, wherein the mass spectrometer comprises a time-of-flight mass spectrometer.

7. An apparatus for processing signals generated at a detector of a mass spectrometer comprising:

means for applying an offset to the signals generated at the detector; and means for converting offset signals to digital signals;

wherein the offset to the signals has a user-adjustable magnitude and polarity such that a positive polarity offset mode may be selected to improve quantitation accuracy and a negative polarity offset mode may be selected to improve resolution.

8. The apparatus of claim 7, wherein the mass spectrometer comprises a time-of-flight mass spectrometer.

9. An apparatus for processing signals generated at a detector of a mass spectrometer comprising:

an offset generator for generating a signal offset; and a summing amplifier having a first input coupled to the detector for receiving signals generated at the detector, a second input coupled to the offset generator for receiving the signal offset and an output, the summing amplifier adding the signal offset to the detector signals and outputting an offset signal.

10. The apparatus of claim 9, wherein the offset generator includes a digital-to-analog converter configured to convert a digital setpoint to an analog signal offset.

11. The apparatus of claim 9, wherein the mass spectrometer comprises a time-of-flight mass spectrometer.

12. The apparatus of claim 9, wherein the offset generator is adjustable and provides for a magnitude of the signal offset to be varied.

13. The apparatus of claim 9, wherein the offset generator is adjustable and provides for a polarity of the signal offset to be varied.

14. The apparatus of claim 9, wherein the offset generator is adjustable and is provides for a magnitude and a polarity of the signal offset to be varied, a range of the magnitude of the signal offset including a zero signal offset.

15. A system for refining analyte mass data derived from signals generated by a detector of a mass spectrometer comprising:

a signal offset generator for applying a signal offset to the signals generated by the detector creating offset signals according to one of a first mode and a second mode;

an analog-to-digital converter converting the offset signals to digital signals, the digital signals including first digital signals representing offset signals offset according to the first mode and second digital signals representing offset signals offset according to the second mode; and a data acquisition and analysis unit for receiving the digital signals output from the analog-to-digital converter, employing the first digital signals to improve quantitation accuracy of analyte mass data, and employing the second digital signals to improve mass resolution of the analyte mass data.

16. The system of claim 15, wherein the signal offset is non-negative in the first mode and negative in the second mode.

17. The system of claim 16, wherein the signal offset generator is operated to alternate between the first mode and the second mode to generate both positively and negatively offset signals.

18. The system of claim 17, wherein the alternation takes place between a substantially zero offset in the first mode, and a larger negative offset in the second mode.

19. The system of claim 17, wherein the data acquisition and analysis unit calculates magnitudes of peaks in the analyte mass data based on the first digital signals, and assigns mass values to the peaks based on the second digital signals.

20. The system of claim 16, further comprising:

a summing amplifier for adding the signal offset to the signals generated by the detector and providing summed signals to the analog-to-digital converter.

21. The system of claim 16, wherein the mass spectrometer comprises a time-of-flight mass spectrometer.

* * * * *